US005374508A

United States Patent [19]

Miura et al.

[11] Patent Number: 5,374,508

[45] Date of Patent: Dec. 20, 1994

[54] SUPPORT SHEET FOR PHOTOGRAPHIC PRINTING SHEET

[75] Inventors: Takaharu Miura, Chiba; Masataka Itoh, Yokohama; Chieko Tanaka, Ichikawa, all of Japan

[73] Assignee: New Oji Paper Co., Ltd., Tokyo, Japan

[21] Appl. No.: 94,877

[22] Filed: Jul. 22, 1993

Related U.S. Application Data

[63] Continuation-in-part of Ser. No. 810,076, Dec. 19, 1991, abandoned.

[30] Foreign Application Priority Data

Dec. 21, 1990 [JP] Japan ..... 2-404784
Jan. 7, 1991 [JP] Japan ..... 3-000172
Apr. 19, 1991 [JP] Japan ..... 3-088709

[51] Int. Cl.[5] ..... G03C 1/815

[52] U.S. Cl. ..... 430/510; 430/523; 430/532; 430/538; 430/935; 430/942; 428/323; 428/481

[58] Field of Search ..... 430/510, 523, 532, 538, 430/935, 942; 428/323, 481

[56] References Cited

U.S. PATENT DOCUMENTS 4,384,040 5/1983 von Meer .
4,396,671 8/1983 Wanka et al. .
4,482,628 11/1984 Katsura et al. .
4,610,956 9/1986 Fuchizawa et al. .
4,645,736 2/1987 Anthonsen et al. .
4,665,013 5/1987 Sach et al. .
4,729,945 3/1988 Anthonsen et al. .
4,731,285 3/1988 Anthonsen .
4,844,777 7/1989 Anthonsen et al. .

FOREIGN PATENT DOCUMENTS 57-49946 3/1982 Japan .
59-124336 7/1984 Japan .
60-17104 5/1985 Japan .
60-17105 5/1985 Japan .
60-144736 7/1985 Japan .
62-61049 3/1987 Japan .
62-141543 6/1987 Japan .
1-21495 4/1989 Japan .
2058866A 4/1981 United Kingdom .
2078236A 1/1982 United Kingdom .

OTHER PUBLICATIONS

World Patents Index Latest, Section PQ, Week 9030, Derwent Publications Ltd., London, GB; Class P83, AN 90-227079.

*Primary Examiner*—Jack P. Brammer
*Attorney, Agent, or Firm*—Armstrong, Westerman, Hattori, McLeland & Naughton

[57] ABSTRACT

A support sheet for a photographic printing sheet having enhanced anti-fogging and anti-yellowing properties comprises a pulp paper substrate sheet, a front coating layer formed on a front surface of the substrate sheet and comprising a cured resinous material produced from electron beam-curable unsaturated organic compound by an electron beam irradiation thereto and mixed with a white pigment, and a back coating layer formed on a back surface of the substrate sheet and comprising a film-forming synthetic resinous material, in which magnesium hydroxide is contained, as an anti-fogging agent, in the substrate sheet.

6 Claims, 1 Drawing Sheet

SUPPORT SHEET FOR PHOTOGRAPHIC PRINTING SHEET

CROSS REFERENCE TO RELATED APPLICATION

This application is a continuation-in-part application of our application Ser. No. 07/810,076, filed on Dec. 19, 1991 now abandoned.

BACKGROUND OF THE INVENTION

1) Field of the Invention

The present invention relates to a support sheet for a photographic printing sheet. More particularly, the present invention relates to a support sheet for a photographic printing sheet having an enhanced resistance to fogging and yellowing and thus capable of being printed with clear photographic images.

2) Description of the Related Arts

Formerly, a baryta paper sheet was used as a support for a photographic printing sheet. The baryta paper sheet was produced by coating two surfaces of a paper sheet having a good sizing property and mechanical property with a coating material containing a white pigment, for example, barium sulfate.

Recently, a waterproof paper sheet composed of a substrate paper sheet and coating layers formed on two surfaces of the substrate sheet and comprising a polyolefin resin have become widely used as a support sheet for a photographic printing sheet, in place of the baryta sheet.

The photographic printing sheet comprising the waterproof support sheet is advantageous in that, in a developing step for the photographic printing sheet, the highly hydrophobic polyolefin coating layer obstructs a penetration of a developing solution into the support. sheet, and accordingly, the time needed for washing and drying the printing sheet can be shortened, and the shrinkage and elongation of the support sheet be restricted, and thus the photographic printing sheet exhibits a superior dimensional stability.

Nevertheless, the polyolefin resin-coated support sheet is disadvantageous in the following items.

The polyolefin resin coating layer contains an inorganic white pigment, for example, titanium dioxide, for enhancing an opacifying power and a resolving power of the resultant photographic printing sheet but this pigment has a poor dispersion in the polyolefin resin. Also, the pigment contains a volatile substance, and in a melt-extruding step of the polyolefin resin, the volatile substance forms bubbles in the polyolefin resin melt, and thus the resultant polyolefin resin coating layer is sometimes cracked.

To avoid the above-mentioned disadvantages, the amount of the white pigment to be added to the polyolefin resin cannot be increased to a high level sufficient to obtain a satisfactory opacifying and resolving power of the resultant photographic printing sheet. Generally speaking, when the white pigment consists of titanium dioxide, it is difficult to add the titanium dioxide pigment in an amount of about 20% by weight or more to the polyolefin resin. Accordingly, the photographic printing sheet prepared from nhe conventional polyolefin resin-coated support sheet does not have a satisfactory sharpness of the images printed thereon.

Recently, a support sheet for a photographic printing sheet having an electron beam-cured resin coating layer formed by coating a surface of a substrate paper sheet with an electron beam-curable resin composition comprising an organic unsaturated compound curable by an electron beam irradiation, and irradiating an electron beam to the coated layer of the resin composition, was disclosed in, for example, Japanese Examined Patent Publication Nos. 60-17,104 and 60-17,105 and Japanese Unexamined Patent Publication No. 57-49,946.

In this type of support sheet, the resin composition to be coated on a surface of a substrate paper sheet need not be heated at a high temperature, and thus can contain the inorganic white pigment in a large amount of 20 to 80% by weight. Therefore, the resultant photographic printing sheet produced from this type of support sheet can record thereon photographic images with a significantly enhanced sharpness, in comparison with those of the conventional polyolefin resin-coated photographic printing sheet.

Nevertheless, this type of photographic printing sheet, in which a photo-sensitive layer is formed on an electron beam-cured resin coating layer, is disadvantageous in that, when developed with a developing solution of photographic chemicals, a portion of the developing chemicals is adsorbed by and remains on the electron beam-cured resin coating layer, and causes the printing sheet to turn yellow after the development. Also, when developed after storage for a long time, non-neglectable fogging occurs in the developed photographic printing sheet, or the photo-sensitivity of the photographic printing sheet is changed.

Various attempts have been made to eliminate the above-mentioned disadvantages. For example, Japanese Examined Patent Publication No. 1-21,495 discloses an attempt to form a polyethylene coating layer on an electron beam-cured resin coating layer, to thereby restrict the change in the photosensitivity during a storage of the photographic printing sheet. This attempt is disadvantageous, however, in that, to obtain a satisfactory prevention of the change in the photosensitivity, the polyolefin coating layer must be formed in a large thickness, and this causes the sharpness of the resultant photographic images to become unsatisfactory, even though the electron beam-cured resin coating layer is employed to increase the sharpness of the printed images.

Japanese Unexamined Patent Publication No. 60-144,736 discloses an attempt to arrange a barrier layer between a substrate paper sheet and an electron beam-cured resin coating layer, to thus restrict any change in the photographic sensitivity of the photographic printing sheet. The barrier layer made from the materials disclosed in the Japanese Publication, however, is not satisfactory when trying to prevent the occurrence of fogging after storage for a long time.

Also, Japanese Unexamined Patent Publication Nos. 62-61,049 and 61-141,543 discloses a specific polymer or monomer for forming the barrier layer, but this specific polymer or monomer does not satisfactorily remove the above-mentioned disadvantages.

Further, Japanese Unexamined Patent Publication No. 59-124,336 discloses a barrier layer arranged between a substrate paper sheet and an electron beam-cured resin coating layer and prepared from at least one member selected from aqueous solutions of water-soluble polymeric material and dispersions of polyolefin homopolymers and copolymers and polyacrylate and polymethacrylate homopolymers and copolymer, to restrict the change in photographic sensitivity.

The barrier layer made from the polymeric material disclosed in the Japanese Publication does not provide a satisfactory prevention of fogging of the resultant photographic printing sheet after a storage thereof for a long time.

Generally, it is known that the relationship between the energy level of the electron beam applied to an electron beam-curable compound composition and the fog density of the resultant photographic printing sheet due to a developing solution is contrary to the relationship between the energy level of the electron beam and the yellowing density. Namely, when the electron beam is applied in a large energy level the yellowing caused by the developing solution is restricted to a low level but the fogging is promoted to a high intensity. Also, when the electron beam is applied in a low energy level, the yellowing density is significantly increased, whereas the fog density is decreased, and the physical properties, for example, adhesive strength and mechanical strength, of the resultant cured resin coating layer are poor.

Accordingly, to prevent or restrict the yellowing and fogging of the photographic printing sheet without affecting the physical properties of the cured resin coating layer, it is necessary to control the energy level of the electron beam to an optimum level. Also, to eliminate all of the above-mentioned disadvantages, it is very important to provide a new type of support sheet capable of preventing the yellowing and fogging of the resultant photographic printing sheet without depending on the quantity of the electron beam applied in the formation of the crated resin coating layer.

SUMMARY OF THE INVENTION

An object of the present invention is to provide a support sheet for a photographic printing sheet having a high surface smoothness, a satisfactory water resistance and an excellent resistance to yellowing and fogging even after a storage for a long time.

The above-mentioned object can be attained by the support sheet for a photographic printing sheet of the present invention, which comprises, a substrate sheet comprising a cellulosic pulp material;

- a front coating layer located on a front surface of the substrate sheet and comprising a mixture of an electron beam irradiation-curing product of at least one electron beam-curable unsaturated organic compound and a white pigment; and
- a back coating layer located on a back surface of the substrate sheet and comprising a film-forming synthetic resinous material, the substrate sheet containing an anti-fogging agent consisting essentially of magnesium hydroxide in an amount of 1 g/m$^2$ or more and in a proportion of 0.1 to 70% based on the total weight of the substrate sheet.

DESCRIPTION OF THE PREFERRED EMBODIMENTS

Figure 1:
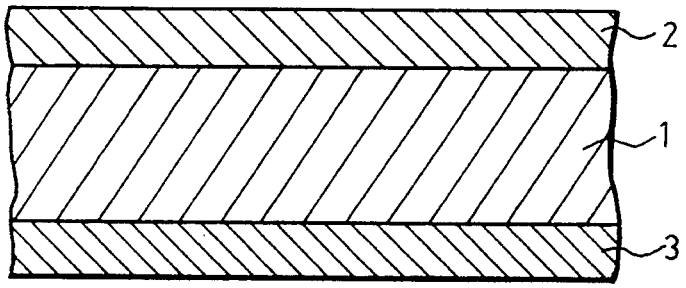
FIG. 1 shows an explanatory cross-sectional profile of an embodiment of the support sheet of the present invention.

Generally, it is known that, when a photographic printing sheet is produced by coating a photographic emulsion layer on a support sheet comprising a substrate sheet comprising a cellulosic pulp paper sheet and a resin coating layer formed by coating an electron beam-curable unsaturated organic compound composition on a surface of the substrate sheet and applying an electron beam irradiation thereto, a significant fogging occurs in the resultant photographic printing sheet during a storage thereof.

Although the mechanism of the fogging phenomenon is not completely clear, it is assumed that active radicals are generated in the photographic printing sheet due to the electron beam irradiation, and the active radicals react with the photographic emulsion layer to create the fogging phenomenon.

Also, it is assumed that the active radicals are generated mainly from cellulose in the substrate sheet and the electron beam-cured resin, and the fogging phenomenon is mainly influenced by the the active radicals generated from the cellulose.

The inventors of the present invention discovered for the first time that the fogging phenomenon can be prevented or restricted by adding magnesium hydroxide in an amount of 1 g/m$^2$ or more, in the substrate sheet.

The mechanism of preventing or restricting the fogging phenomenon by utilizing magnesium hydroxide has not been made completely clear, but it is assumed that the penetration of the active radicals generated from the cellulose in the substrate sheet by the electron beam irradiation into the photographic emulsion layer is prevented or hindered by some actions of magnesium hydroxide, and thus the anti-fogging property of the photographic printing sheet is improved.

Accordingly, in the formation of the cured resin coating layer on the base paper sheet-containing substrate sheet, even when the electron beam is applied at an energy level high enough to prevent the yellowing of the photographic printing sheet, the fogging of the photographic printing sheet can be satisfactorily restricted.

Referring to FIG. 1, a support sheet for a photographic printing sheet is composed of a substrate sheet 1 consisting of a paper sheet, a front coating layer 2 formed on a front surface of the substrate sheet 1, and a back coating layer 3 formed on a back surface of the substrate sheet.

The anti-fogging and yellowing agent consisting essentially of magnesium hydroxide is contained in the substrate paper sheet 1. Preferably, the magnesium hydroxide is in the form of fine solid particles having an average size of 0.1 to 100 $\mu$m.

Optionally, magnesium hydroxide is used in the state of a mixture with an additional white pigment, for example, finely divided calcium carbonate, titanium dioxide, talc, clay, barium sulfate and aluminum oxide. There is no limitation of the amount of the additional pigment to be mixed to magnesium hydroxide, and the additional pigment is employed preferably in an amount of 40% or less based on the total weight of magnesium hydroxide and the additional pigment. If the amount of the additional pigment is more than 40%, sometimes the anti-fogging effect of magnesium hydroxide becomes unsatisfactory.

The substrate paper sheet for the substrate sheet is usually selected from paper sheets made from softwood pulp, hardwood pulp, and a mixture of the softwood and hardwood pulps. Also, the wood pulps are not limited to specific types of pulps made by specific pulping methods, but preferably are selected from the kraft pulps, sulfite pulps and soda pulps usually used for making paper sheets. If necessary, the wood pulps are blended with a synthetic pulp or synthetic fibers, to make the paper sheets.

There is no restriction on the type, basis weight and thickness of the substrate paper sheet, but preferably the substrate paper sheet has a high surface smoothness enhanced by applying a compressive force thereto by a calender or the like, and has a basis weight of from 50 to 300 g/m$^2$ and a thickness of 40 to 270 μm.

The substrate paper sheet usable for the present invention optionally contains at least one paper additive, for example, dry paper strength reinforcers, for example, cationic starches, cationic polyacrylamides, and anionic polyacrylamides, sizing agents, for example, fatty acid salts, rosin, maleic acid-modified rosin, cationic sizing agents, and reactive sizing agents, fillers, for example, clay, talc, and kaolin, wet paper strength reinforcers, for example, melamine-formaldehyde resins and epoxidized polyamide resins, fixing agents, for example, aluminum sulfate and cationic starches, and pH-adjusting agents, for example, caustic soda and sodium carbonate. The paper sheet can be tub-sized or size-pressed by a treating liquid containing at least one member selected from water-soluble polymeric additives, sizing agents, inorganic electrolytes, hygroscopic substances, pigments and pH-adjusting agents.

In the production of the paper sheet containing the magnesium hydroxide, magnesium hydroxide is mixed into a pulp slurry, and the mixed pulp slurry is converted to a paper sheet. Alternatively, magnesium hydroxide is incorporated into a paper sheet by a press-sizing method in which the paper sheet is coated or impregnated with a dispersion containing magnesium hydroxide. In the substrate paper sheet, the anti-fogging magnesium hydroxide is present in an amount of 0.1 to 70%, preferably 1 to 40%, based on the total weight of the substrate sheet. If the amount of magnesium hydroxide is less than 0.1% by weight, the resultant photographic printing sheet exhibits an unsatisfactory anti-fogging effect. Note, the use of magnesium hydroxide in an excessively large amount of more than 70% by weight is not effective for successively enhancing the anti-fogging effect, and sometimes results in a lowering of the paper strength, an undesirable powdering, and in a deterioration of the photographic performance of the photographic printing sheet.

In the support sheet of the present invention, a front coating layer is formed on a front surface of the substrate sheet. This front coating layer comprises, as a principal component, a mixture of a cured resinous material with a white pigment. The cured resinous material is produced from at least one unsaturated organic compound capable of being cured by irradiating an electron beam thereto.

The electron beam-curable unsaturated organic compound usable for the present invention is preferably selected from the group consisting of:

(1) acrylate compound (or acrylic acid esters) of mono-to hexahydric aliphatic, cycloaliphatic and aromatic alcohols and polyalkyleneglycols;
(2) acrylate compounds (or acrylic acid esters) of addition products of mono-to hexahydric aliphatic, cycloaliphatic and aromatic alcohols with alkyleneoxides;
(3) polyacryloylalkylphosphoric acid esters;
(4) reaction products of carboxylic acids with polyols and acrylic acid;
(5) reaction products of isocyanates with polyols and acrylic acids;
(6) reaction products of epoxy compounds with acrylic acid; and
(7) reaction products of epoxy compounds with polyols and acrylic acid.

The electron beam-curable unsaturated organic compounds include, for example, polyoxyethylene-epichlorohydrin-modified bisphenol A diacrylate, dicyclohexylacrylate, epichlorohydrin-modified polyethyleneglycol diacrylate, 1,6-hexanediol diacrylate, hydroxypivalic acid ester-neopentylglycol diacrylate, nonylphenoxy-polyethyleneglycol acrylate, ethyleneoxide-modified phenoxidized phosphoric acid acrylate, ethyleneoxide-modified phthalic acid acrylate, polybutadieneacrylate, caprolactam-modified tetrahydrofurfuryl acrylate, tris(acryloxyethyl) isocyanurate, trimethylolpropane triacrylate, penta-erythritol triacrylate, dipentaerythritol hexaacrylate, polyethyleneglycol diacrylate, 1,4-butadienediol diacrylate, neopentylglycol diacrylate, and neopentyl-glycol-modified trimethylolpropanediacrylate.

The white pigment in the front coating layer preferably comprises at least one member selected from the group consisting of titanium dioxide which may be an anatase type or rutile type, barium sulfate, calcium carbonate, zinc oxide and aluminum oxide.

To enhance a dispersing property of the white pigment particles, for example, titanium dioxide particles, the surfaces of the pigment particles are coated with metal oxide, for example, aluminum oxide.

The white pigment is preferably present in an amount of 20 to 80%, based on the total amount of the front coating layer.

If the content of the white pigment is less than 20% by weight, the resultant front coating layer exhibits an unsatisfactory opacifying power, and thus the photographic images recorded on the resultant photographic printing sheet have an unsatisfactory sharpness and clarity. If the content of the white pigment is more than 80% by weight, the resultant front coating layer exhibits an unsatisfactory flexibility, and thus is sometimes cracked.

The front coating layer can be formed by coating a front surface of a substrate sheet with a coating liquid containing the electron beam-curable unsaturated organic compound and the white pigment, and irradiating an electron beam to the resultant coating liquid layer, to cure and solidify same.

The coating liquid for the front coating layer can be prepared by a conventional dispersing apparatus, for example, a three roll mill, two roll mill, Cowless dissolver, homomixer, sand grinder, Dyno mill, and ultrasonic dispersing machine.

The coating operation of the coating liquid on the substrate paper sheet can be carried out by a conventional coating method, for example, bar coating method, air doctor coating method, blade coating method, squeeze-coating method, air-knife coating method, reverse roll coating method or transfer-coating method. Further, a fountain coating method or a slit die coating method can be applied to the coating operation.

The resultant coating liquid layer on the substrate paper sheet can be dried by a conventional drying method.

To obtain a front coating layer having a high surface smoothness and gloss, the coating operation is preferably carried out by a coating method in which a casting drum is employed.

The irradiation of the electron beam is carried out to cure and solidify the coated coating liquid layer on the substrate sheet. For this electron beam irradiation, preferably a curtain type electron beam accelerator, which is relatively cheap and can generate a large output, is utilized. In this accelerator, the accelerating voltage for electron beam is usually from 100 to 300 kV and the energy level is from 0.1 to 6 Mrad, more preferably 0.2 to 4 Mrad.

If the energy level is less than 0.1 Mrad, the reaction of the unsaturated bonds in the unsaturated organic compound in the coated coating liquid layer sometimes cannot be completed, and thus a non-reacted unsaturated organic compound remains in the cured resinous layer and sometimes affects the photographic property of the resultant photographic printing sheet.

Generally, when the energy level is small, the degree of cross-linkage of the cured resin becomes low, and thus the anti-yellowing property of the resultant photographic printing sheet is affected by the low cross-linkage of the cured resin.

When the support sheet of the present invention is employed, the resultant photographic printing sheet exhibits a high anti-fogging property even if the electron beam curing is carried out at a high energy level. Also, when the electron beam irradiation is carried out at a high energy level, the resultant photographic printing sheet exhibits an enhanced anti-yellowing property.

Nevertheless, the energy level of the electron beam must be controlled to an appropriate level, because an excessively high energy level results in a wasteful consumption of energy, and sometimes causes the resultant front coating layer to exhibit an undesirably high hardness and rigidity, and thus the resultant photographic printing sheet is curled.

The electron beam irradiation is preferably carried out in a non-oxidative atmosphere containing oxygen in a restricted concentration of 500 ppm or less. If the oxygen concentration is more than 500 ppm, the oxygen serves as a retarding agent for a polymerization the unsaturated organic compound, and thus the curing reaction of the unsaturated organic compound becomes poor.

When the electron beam curing is carried out by a drum curing method, in which a coating liquid layer formed on a substrate sheet is brought into contact with the peripheral surface of a curing drum and a electron beam is irradiated to the coating liquid layer through the substrate sheet, the coating liquid layer is not directly exposed to the ambient air atmosphere, and thus this electron beam irradiation can be effected without lowering the oxygen concentration of the atmosphere. Nevertheless, this drum curing operation using the electron beam irradiation may be carried out in an inert gas atmosphere, to prevent or hinder a generation of ozone due to the electron beam irradiation through the atmosphere, or to cool a window through which the electron beam is irradiated and which is exothermically heated by the electron beam irradiation.

The front coating layer preferably has a weight of 2 to 60 g/m$^2$ more preferably 10 to 30 g/m$^2$.

In the support sheet of the present invention, a back coating layer is formed on a back surface of the substrate sheet. This back coating layer comprises a film forming synthetic resin which can be selected from conventional synthetic resins usable for coating the substrate sheet for photographic printing sheet.

The synthetic resins include polyolefin resins and the same electron beam-cured resins as mentioned above.

The polyolefin resins include homopolymers of ethylene and $\alpha$-olefins, for example, propylene, copolymers of at least two of ethylene and $\alpha$-olefins, and mixtures of at least two of the above-mentioned homopolymers and copolymers.

Preferable polyolefin resins for the present invention are low density polyethylene resins, high density polyethylene resins, linear chain type low density polyethylene resins, and mixtures of at least two of the above-mentioned resins.

There is no specific limitation of the molecular weight of the polyolefin resins, but preferably the molecular weight of the polyolefin resins is from 20,000 to 200,000.

The back coating layer comprising the polyolefin resin can be formed on the back surface of the substrate sheet by a customary melt extrusion-coating method.

The back coating layer comprising the electron beam-cured resinous material can be formed by the same method as that used for the front coating layer, as mentioned above.

The back coating layer optionally contains at least one additive for example, an anti-oxidant or surfactant.

Preferably, the back coating layer has a weight of 10 to 40 g/m$^2$.

EXAMPLES

The present invention will be further explained by the following specific examples, which are only representative and in no way restrict the scope of the present invention.

Example 1

A mixed pulp slurry with a consistency of 1.0% was prepared from a mixture of 20% by weight of a bleached softwood sulfate pulp (NBSP) beaten to a Canadian standard freeness of 250 ml and 80% by weight of a bleached hardwood kraft pulp (LBKP) beaten to a Canadian standard freeness of 280 ml determined in accordance with Japanese Industrial Standard P 8121-76.

To the mixed pulp slurry was added an additive having the following composition:

| Component | Amount by weight(*)[1] |
|---|---|
| Cationic starch derivative | 2.0% |
| Alkylketone dimer resin | 0.4% |
| Anionic polyacrylic amide resin | 0.1% |
| Polyamidepolyamineepichlorohydrin resin | 0.7% |

Note:
(*) . . . The amount in % is based on the dry weight of the mixed pulp.

The composition was mixed with an aqueous sodium hydroxide solution, to adjust the pH of the composition to a level of 7.5.

The mixed pulp was uniformly suspended in water, and then to the resultant pulp slurry was added finely divided magnesium hydroxide in an amount such that after the resultant pulp slurry was converted to a paper sheet the content of magnesium hydroxide being 5% based on the dry weight of the resultant paper sheet, while agitating the mixture for 5 minutes.

The consistency of the solid content of the mixed pulp slurry was adjusted to 0.05% and then the adjusted slurry was further agitated for 5 minutes.

A paper sheet having a basis weight of 180 g/m$^2$ and a density of 1.0 g/cm$^3$ was produced from the resultant mixed pulp slurry, by using a hand paper-making machine available from Toyo Seiki K.K.

The resultant paper sheet was employed as a substrate sheet.

A back surface of the substrate sheet was coated with a polyethylene resin by a customary melt extrusion-coating method.

The resultant back coating layer had a weight of 30 g/m$^2$.

Separately, an electron beam-curable resinous composition was prepared in the following composition:

| Component | Part by weight |
|---|---|
| Epoxy acrylate oligomer(*)$_2$ | 70 |
| Di-functional acrylate monomer(*)$_3$ | 30 |
| Titanium dioxide (*)$_4$ | 25.0 |

Note:
(*)$_2$ . . . Available under the trademark of Viscoat 540, from Osaka Yukikayaku K.K.
(*)$_3$ . . . Available under the trademark of HDDA, from Nihon Kayaku K.K.
(*)$_4$ . . . Available under the trademark of A220, from Ishihara Sangyo K.K.

The composition was mixed and dispersed in a paint conditioner for one hour.

A front surface of the substrate sheet was coated with the electron beam curable resinous composition in an amount of 25 g/m$^2$ by using a wire coating bar. Then an electron beam was applied to the composition layer under an accelerating voltage of 165 kV at an energy level of 3 Mrad, to cure the composition layer.

A specimen of the resultant support sheet was subjected to an measurement of an anti-fogging effect thereof, in the following manner.

The specimen of the support sheet was superimposed on a specimen of a conventional photographic printing sheet so that the front coating layer of the support sheet specimen came into contact with a photographic emulsion layer surface of the photographic sheet specimen, and the resultant test piece was left to stand in a dark room at a temperature of 70° C. at a relative humidity of 50% for 3 days. Then the support sheet specimen was separated from the photographic sheet specimen, and the photographic sheet specimen was subjected to a customary development by using an automatic developing machine available under the trademark of RCP20, from Dast Co.

The fog density of the developed specimen was measured in a customary manner by using a Macbeth densitometer available under the trademark of Model No. RD-914, from Kollmorgen Corp.

The test results are shown in Table 1.

Example 2

The same experimental procedures as in Example 1 were carried out except that the final content of magnesium hydroxide in the paper sheet after the paper-making step was adjusted to 60%, based on the total dry weight of the paper sheet.

The test results are shown in Table 1.

Comparative Example 1

The same experimental procedures as in Example 1 were carried out except that no magnesium hydroxide was added to the paper sheet.

The test results are shown in Table 1.

Referential Example 1

A resin-coated paper sheet was produced by coating two surfaces of a paper sheet not containing magnesium compound with a polyethylene in an amount of 25 g/m$^2$.

The same test as mentioned in Example 1 was applied to the resin-coated paper sheet.

The test results are shown in Table 1.

Comparative Example 2

The same experimental procedures as in Example 1 were carried out except that magnesium hydroxide was replaced by magnesium sulfide ($MgSO_4$) in an amount of 5% based on the total dry weight of the resultant paper sheet.

The test results are shown in Table 1.

Comparative Example 3

The same experimental procedures as in Example 1 were carried out except that magnesium hydroxide was replaced by magnesium oxide (MgO) in an amount of 5% based on the total dry weight of the resultant paper sheet.

The test results are shown in Table 1.

Comparative Example 4

The same experimental procedures as in Example 1 were carried out except that magnesium hydroxide was replaced by magnesium silicate ($Mg_2SiO_4$) in an amount of 5% based on the total dry weight of the resultant paper sheet.

The test results are shown in Table 1.

Comparative Example 5

The same experimental procedures as in Example 1 were carried out except that magnesium hydroxide was replaced by calcium carbonate ($CaCO_3$) in an amount of 5% based on the total dry weight of the resultant paper sheet.

The test results are shown in Table 1.

TABLE 1

| Example No. | Item: Magnesium compound contained in substrate paper sheet — Type | Amount (% by wt) | Energy level of electron beam (Mrad) | Fog density |
|---|---|---|---|---|
| Example 1 | $Mg(OH)_2$ | 5 | 3 | 0.12 |
| Example 2 | $Mg(OH)_2$ | 60 | 3 | 0.11 |
| Comparative Example 1 | None | — | 3 | 2.03 |
| Referential Example 1 | RC paper sheet | | — | 0.14 |
| Comparative Example | | | | |
| 2 | $MgSO_4$ | 5 | 3 | 0.19 |
| 3 | MgO | 5 | 3 | 0.20 |
| 4 | $Mg_2SiO_4$ | 5 | 3 | 0.25 |
| 5 | $CaCO_3$ | 5 | 3 | 2.00 |

In Examples 1 and 2, the fog density of the developed specimens was less than 0.15 and it was confirmed that no fogging and yellowing of the resultant photographic printing sheets occured even after storage for 12 months, whereas in Comparative Examples 2 to 4 in which the magnesium compounds different from magnesium hydroxide were used in place of magnesium hydroxide, the resultant fog density of the developed specimens was more than 0.15.

Also, in Comparative Example 1 in which no antifogging agent was used and in Comparative Example 5 in which calcium carbonate was used in place of magnesium hydroxide, the resultant developed specimens fogged significantly.

We claim:

1. A support sheet for a photographic printing sheet comprising:

a substrate sheet comprising a cellulosic pulp material;

a front coating layer located on a front surface of the substrate sheet and comprising a mixture of an electron beam irradiation-curing product of at least one electron beam-curable unsaturated organic compound and a white pigment; and a back coating layer located on a back surface of the substrate sheet and comprising a film-forming synthetic resinous material, said substrate sheet containing an anti-fogging agent consisting essentially of magnesium hydroxide in an amount of 1 g/m$^2$ or more, and in a proportion of 0.1 to 70% based on the total weight of the substrate sheet.

2. The support sheet as claimed in claim 1, wherein the substrate sheet has a basis weight of 50 to 300 g/m$^2$.

3. The support sheet as claimed in claim 1, wherein the electron beam-curable organic unsaturated compound is selected from the group consisting of:

(1) acrylate compounds of mono- to hexa-hydric aliphatic, cycloaliphatic and aromatic alcohols and polyalkyleneglycols;

(2) acrylate compounds of addition reaction products of mono- to hexa-hydric aliphatic, cycloaliphatic and aromatic alcohols with alkylene-oxides;

(3) polyacryloylalkylphosphoric acid esters (4) reaction products of carboxylic acids with polyols and acrylic acid (5) reaction products of isocyanates with polyols and acrylic acid;

(6) reaction products of epoxy compounds with acrylic acid; and (7) reaction products of epoxy compounds with polyols and acrylic acid.

4. The support sheet as claimed in claim 1, wherein the front coating layer has a weight of 2 to 60 g/m$^2$.

5. The support sheet as claimed in claim 1, wherein the film-forming synthetic resinous material in the back coating layer comprises at least member selected from polyolefin resins, and cured resinous materials produced from at least one electron beam-curable organic unsaturated compound by irradiating an electron beam thereto.

6. The support sheet as claimed in claim 1, wherein the back coating layer has a weight of 10 to 40 g/m$^2$.

* * * * *